US006409054B1

(12) United States Patent
Garibaldi

(10) Patent No.: US 6,409,054 B1
(45) Date of Patent: Jun. 25, 2002

(54) POURER CAP WITH CLOSURE COVER

(75) Inventor: Angelo Garibaldi, Colnago (IT)

(73) Assignee: Capsol Berry Plastics SpA, Colnago (IT)

( * ) Notice: Subject to any disclaimer, the term of this patent is extended or adjusted under 35 U.S.C. 154(b) by 0 days.

(21) Appl. No.: 09/995,600

(22) Filed: Nov. 29, 2001

(30) Foreign Application Priority Data

Dec. 1, 2000 (IT) ..... MI00A2607

(51) Int. Cl.[7] ..... B65D 47/06

(52) U.S. Cl. ..... 222/524; 222/525; 222/531; 222/556

(58) Field of Search ..... 222/524, 525, 222/531, 556

(56) References Cited

U.S. PATENT DOCUMENTS

| | | | | |
|---|---|---|---|---|
| 3,135,441 A | | 6/1964 | Wise et al. | |
| 3,283,966 A | * | 11/1966 | Miller | 222/525 |
| 4,236,653 A | * | 12/1980 | Gach | 222/556 |
| 4,298,146 A | * | 11/1981 | Montgomery | 222/556 |
| 4,463,882 A | * | 8/1984 | Hammett | 222/543 |
| 4,976,364 A | * | 12/1990 | Solomon | 215/229 |
| 5,472,120 A | * | 12/1995 | Stebick et al. | 222/525 |
| 5,497,906 A | * | 3/1996 | Dubach | 222/556 |

FOREIGN PATENT DOCUMENTS

| | | |
|---|---|---|
| EP | 0 024801 A1 | 3/1981 |
| EP | 1035030 A1 | 9/2000 |
| FR | 2648112 | 12/1990 |
| WO | WO 94/29184 | 12/1994 |

* cited by examiner

*Primary Examiner*—Kenneth Bomberg
(74) *Attorney, Agent, or Firm*—Oblon, Spivak, McClelland, Maier & Neustadt, P.C.

(57) ABSTRACT

A pourer cap with closure cover for fluid substance containers has a main body and a cover joined together by a flexible tang, all formed in one piece by moulding plastic material, the cover being superposable on the main body and having a delivery hole which is opened or respectively sealingly closed when the cover is in a raised or respectively lowered position on the main body, the angular movement of the cover between one position and the other being of small extent.

3 Claims, 3 Drawing Sheets

POURER CAP WITH CLOSURE COVER

BACKGROUND OF THE INVENTION

1. Field of the Invention

The present invention relates to a pourer cap with closure cover for fluid substance containers, which is formed in one piece from moulded plastic material and is able to prevent and respectively allow dispensing of the substance by slightly moving the cover relative to a main body on which the cover is superposed.

2. Discussion of the Related Art

It is common practice to contain liquid, fluid or creamy substances in containers, usually of plastic material, the mouth of which can either be closed by a cover screwed onto the neck of the respective container, and which has to be removed to effect dispensing, or be closed by a pourer cap formed in two pieces movable one relative to the other and which prevent dispensing of the substance or allow this dispensing by simple slight axial movement of one piece relative to the other.

Pourer caps of this type are described, for example, in U.S. Pat. No. 4,383,623, U.S. Pat. No. 4,690,304, U.S. Pat. No. 4,779,764 and EP-A-1035030; these caps comprise a main body sealingly mounted on the mouth of a container, and a movable member, superposed on the main body and displaceable relative thereto between a position in which a delivery hole provided in the movable member is sealingly closed by an appendix projecting from the main body and a position in which this delivery hole is raised relative to said appendix to enable dispensing of the substance contained in the container. The pourer caps of the type illustrated in the cited patents present two serious drawbacks, the first of which consists of the fact that they comprise two separate component parts which have to be produced separately and then mounted one on the other before being applied to the container mouth, with obvious costs involved; the second drawback is that when the user wishes to open a pourer cap (to use the substance present in the container) or, vice versa, wishes to close it, he has to grip the container with one hand, while with the other hand he moves the movable member relative to the main body of the cap, this often causing problems.

U.S. Pat. No. 3,135,441 describes a pourer cap comprising a main body and a cover which are joined together by a flexible tang, the whole being formed in one piece by moulding plastic material, in which the main body delimits a discharge hole and presents in its lower part a seat for housing and sealingly retaining the free edge of the neck of a fluid substance container. The cover can be rotated onto the main body, on which it can be retained (by means of mutually cooperating profiled portions on each) in a position in which the cover sealingly closes the discharge hole in the main body.

When the substance is to be delivered, the cover is opened by disengaging it from the main body and rotating it through 180° laterally to this body, so that the discharge hole is completely freed and the substance can be delivered.

To dose the cap, the cover is rotated through 180° about the flexible tang which joins it to the main body, to move it from its position to the side of the main body to a position in which the cover is superposed on this latter, to close its discharge hole.

The pourer cap of U.S. 3,135,441 also has two drawbacks, one of which consists of the fact that to move it from its closure position to its dispensing position or vice versa, the user has to use both hands, one to grip the container and the other to rotate the cover relative to the main body; another drawback is that when the cover has been turned over into its open position, the discharge hole is completely open and free, such that it becomes difficult to pour small or controlled quantities of the fluid substance, part of which always trickles to the outside of the cap, so soiling it.

SUMMARY OF THE INVENTION

The main object of the present invention is to provide a one-piece pourer cap with closure cover formed by moulding plastic material, the cover of which can be opened and respectively closed with one finger of the same hand which grips the container on which the cap is mounted, and of which the degree of opening of the discharge hole in the cap can be easily regulated by the user to enable the flow of delivered substance to be controlled between a minimum and a maximum.

This and further objects are attained by a pourer cap comprising a main body having an upper part and a lower part and a cover joined thereto by a flexible tang, all formed in one piece by moulding plastic material, in which the main body delimits a discharge channel and presents, in its lower part, a seat for housing and sealingly retaining the free edge of the neck of a fluid substance container, the main body and the cover having respective profiled portions mutually cooperating to retain the cover on the upper part of the main body to close said discharge channel, characterised in that the main body comprises a funnel-shaped wall which is inclined towards the bottom of said body and from which there extends a tubular wall which defines said discharge channel by combination with the opposing surface of an appendix supported on the inside of the tubular wall by at least one fin projecting from said tubular wall, the appendix having a free end projecting towards the top of the main body beyond said funnel-shaped wall, in the cover there being provided a delivery hole about the whole of which there extends an elongate annular jacket the free end of which is shaped as an outwardly diverging lip and is insertable and movable within said discharge channel to seal against said tubular wall of the main body, the cover delivery hole being superposed on and sealed by the free end of said appendix when in the closure position in which the cover is lowered onto the main body, the cover and main body being provided with profiled elements which mutually cooperate to limit the raising of the cover on the main body into the dispensing position in which the cover delivery hole is raised away from the free end of said appendix.

In particular, said funnel-shaped wall of the main body has a small thickness such as to flex under the thrust exerted on the tubular wall projecting from it by the lip of the cover annular jacket when in the position in which the cover is partially raised from the main body and said delivery hole is raised away from the free end of said appendix of the main body.

BRIEF DESCRIPTION OF THE DRAWINGS

The structure and characteristics of the pourer cap of the invention will be more apparent from the ensuing description of one embodiment thereof given by way of non-limiting example with reference to the accompanying drawings, in which.

DETAILED DESCRIPTION OF THE INVENTION

As can be seen from FIGS. 1 to 4, the pourer cap comprises a main body A and a cap B joined together by a flexible tang C, all formed in one piece by moulding plastic material; the tang C constitutes a turning hinge of the known type widely used in stoppers with a rotatable cover.

Figure 3:
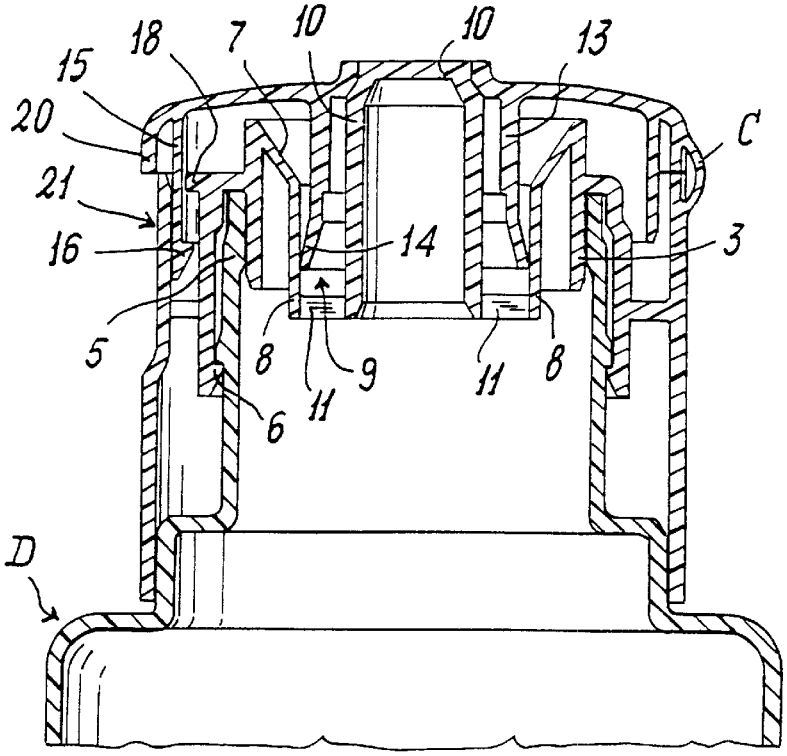
FIGS. 3 and 4 are longitudinal sections through the pourer cap, with the cap lowered into its closure position and respectively raised into its position of maximum opening.

The main body A comprises three coaxial cylindrical walls 1, 2 and 3; the walls 2 and 3 delimit a seat 4 (FIG. 1) arranged to sealingly house the free edge of the neck 5 of a container D for a fluid substance (see FIGS. 3 and 4), said neck being retained securely in the seat 4 by the mutual engagement between profiled ribs 6 projecting inwards from the wall 2 and an annular rib projecting from the outside of the neck 5 and not numbered for simplicity (but visible in FIG. 3).

From the upper end (with respect to FIGS. 1, 3 and 4) of the wall 3 there projects a thin funnel-shaped wall 7 which is inclined towards the bottom of the body A (again with respect to said figures), and from which there extends a cylindrical tubular wall 8 which defines a discharge channel 9 with the opposing surface of an appendix 10 supported on the inside of the wall 8 by four fins 11 projecting inwards from the tubular wall. As can be seen from the drawings, the free end of the appendix 10 projects from the top of the main body A, beyond the funnel-shaped wall 7.

Figure 1:
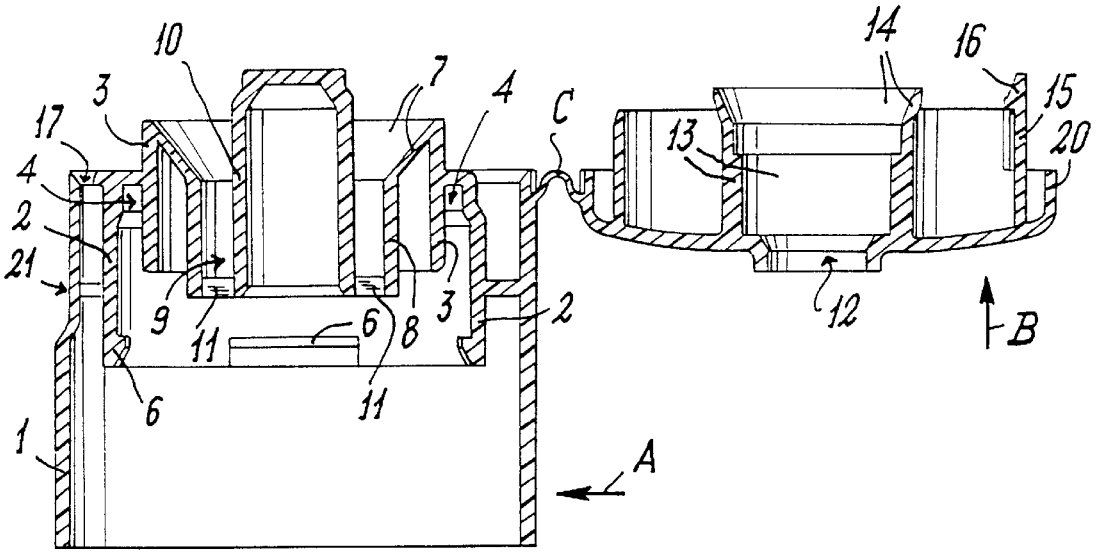
FIG. 1 is a longitudinal section through the pourer cap on the line 1—1 of FIG. 2, with the cover rotated to the side of the main body.
Figure 2:
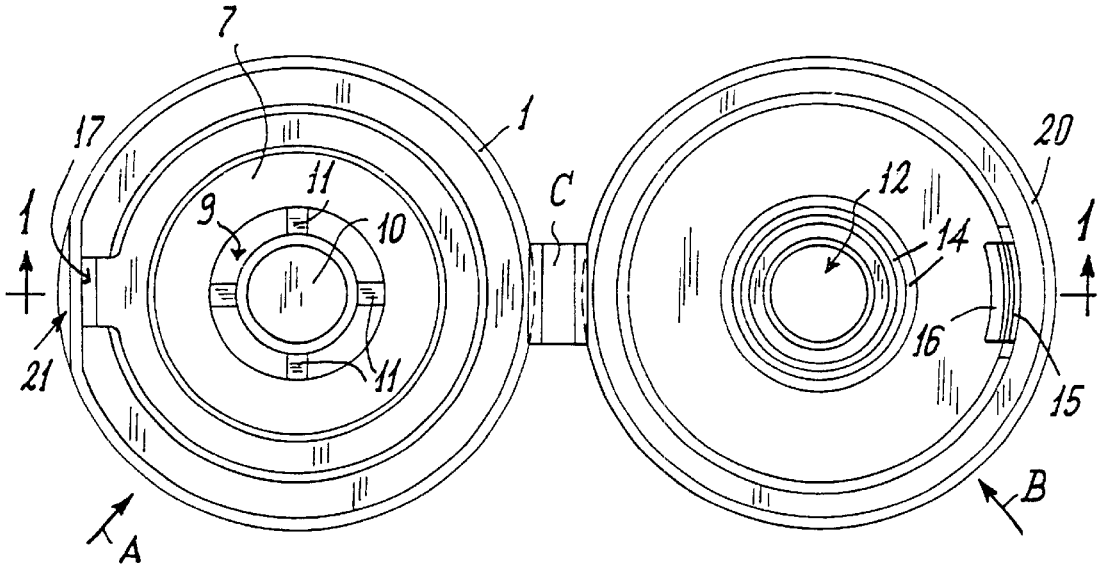
FIG. 2 is analogous to FIG. 1, but with the main body and the cover shown in plan view.
Figure 4:
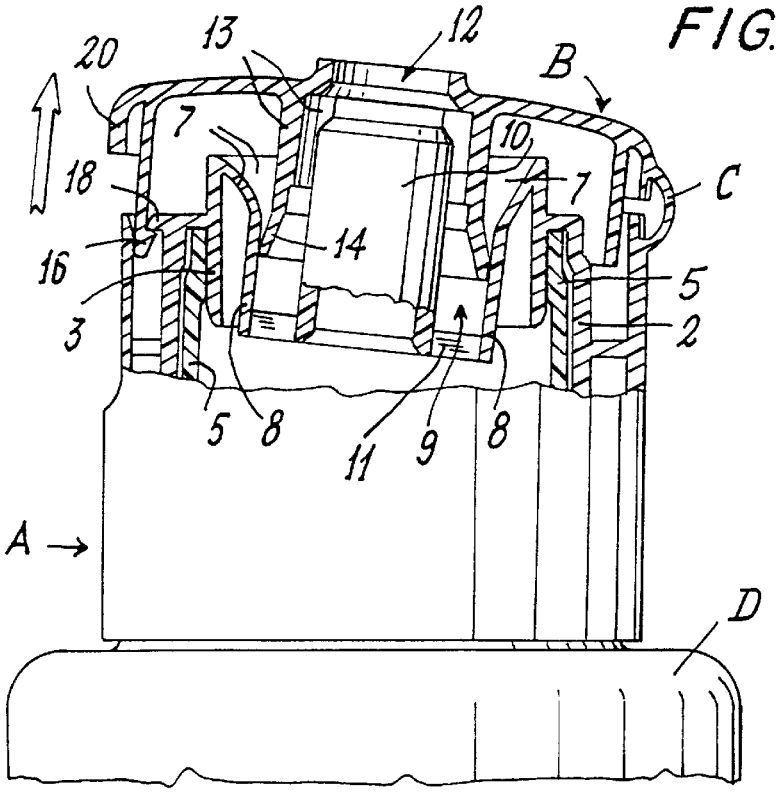

In the cover 8 there is provided a delivery hole 12, about the whole of which there extends an elongate annular jacket 13 the free end of which is shaped as an outwardly diverging lip 14 the dimensions of which must be such that, when the cover B is rotated through 180° (about the tang C) from the position shown in FIGS. 1 and 2, the lip becomes inserted in and movable within the discharge channel 9 while sealing against the inner cylindrical surface of the tubular wall 8 (FIGS. 3 and 4).

It is important to note that the funnel-shaped wall 7 facilitates the insertion of the lip 14 into the tubular wall 8 at the moment in which the cover 8 is folded back onto the main body A of the pourer cap.

It is essential that the cover delivery hole 12 be sealingiy superposable on the free end of the appendix 10 when in the position which closes the pourer cap (FIG. 3), in which the cover B is completely lowered onto the main body A.

From the figures it can be seen that there projects from the cover B a flexible tang 15 from the free end of which there projects a profiled tooth 16, in the top of the main body A there being provided a slot 17 into which the tang 15 can penetrate and extend when the cover 8 is folded back onto the main body A (FIGS. 3 and 4), the tooth 16 interfering with a corresponding profiled tooth 18 provided on one side of the slot 17, to limit the raising of the cover from its most lowered position (FIG. 3) on the main body to its most raised position (FIG. 4) in the condition in which the substance can be poured from the pourer cap.

From FIGS. 1, 3 and 4 it can be seen that the outer surfaces of the teeth 16 and 18 are inclined such that they can slide along each other and can snap one over the other when the cover is folded back onto the main body.

The described dispensing cap has three fundamental characteristics, these being that the tubular wall 8 projects from a funnel-shaped wall 7, that the delivery hole 12 in the cover can be sealingly closed by the free end of the appendix 10, and that the lip 14 of the annular jacket 13 is sealingly slidable along the inner surface of the tubular wall 8.

Preferably the cap also has the further important characteristic that the funnel-shaped wall 7 is sufficiently thin to flex under the thrust which the cover lip 14 exerts on the wall 8 when the cover B is raised on the main body A to allow dispensing of the substance contained in the containers on which the pourer cap has been applied.

When the pourer cap has been produced in one piece by moulding plastic material, it appears as shown in FIGS. 1 and 2.

In FIG. 3 the cap is shown in its closure position already mounted on the mouth 5 of a container D, with the cover rotated back onto the main body and with the flexible tang 15 inserted into the slot 17. In this state the free end of the appendix 10 sealingly closes the delivery hole 12 in the cover, and the lip 14 of the annular jacket 13 seals (in the manner of a piston) against the inner surface of the wall 8, so that the substance present in the container D cannot be poured out.

When this substance is to be delivered, the free edge 20 of the cover is pushed upwards (with respect to FIGS. 3 and 4) in proximity to the flexible tang 15 with the finger of one hand. To facilitate this operation, the wall 1 of the main body presents a depression 21 in that position in which the free edge 20 of the cover lies, so that this can be easily raised into the position of FIG. 4 in which the two teeth 16 and 18 mutually interfere.

In this position (pourer cap open) the substance present in the container can leave from the delivery hole 12, while the lip 14 continues to seal against the inner surface of the wall 8.

Evidently, the more the cover is raised from its closure position, the greater is the free space which forms between the edge of the hole 12 and the free end of the appendix 10, signifying that the outflow of the substance can be adjusted by simply adjusting the amount by which the cover is raised from the main body.

When the cover is lowered from the position of FIG. 4 to that of FIG. 3, the end of the appendix 10 automatically seals the delivery hole 12.

Figure 5:
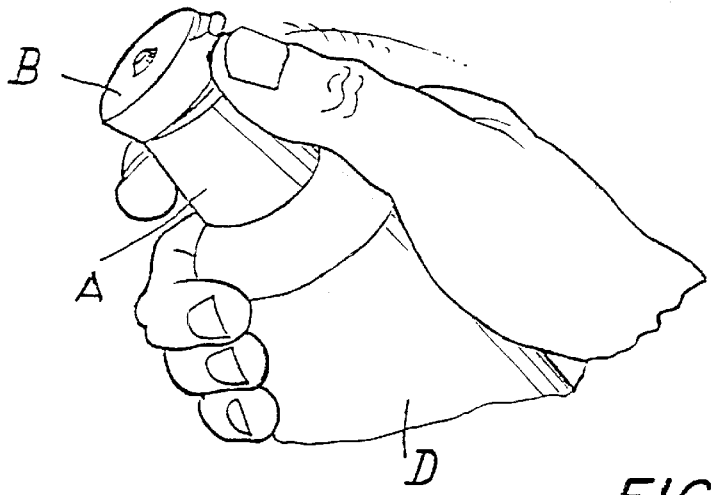
FIGS. 5 to 7 schematically represent the method of operating the pourer cap while the container on which it is mounted is gripped with one hand.
Figure 6:
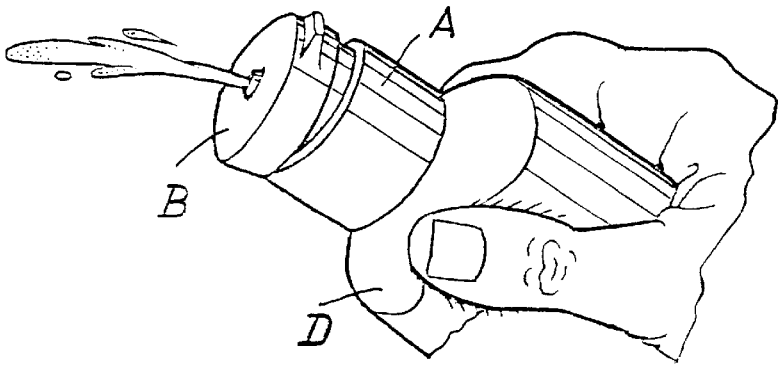
Figure 7:
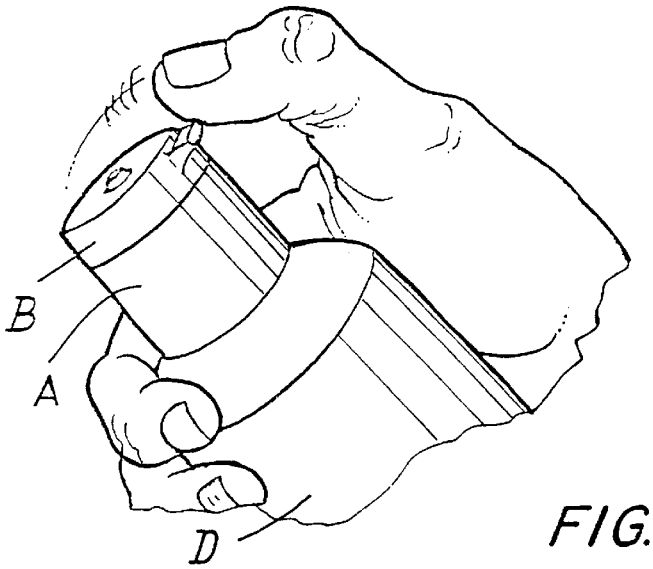

In this manner it is extremely easy to control the opening of the substance delivery hole, simply by gripping the container D with one hand and raising or lowering the cover B on the body A with the thumb of the same hand, as shown schematically in sequence in FIGS. 5, 6 and 7.

That embodiment in which the thickness of the funnel-shaped wall 7 is such that it flexes when the lip 14 pushes laterally against the cylindrical surface of the wall 8, as shown in FIG. 4, has proved particularly advantageous.

In this respect, if the cover is able to be rotated about the main body by a fairly large (although still very small) extent, in order to ensure that the seal is maintained between the lip 14 and the opposing surface of the wall 8 it may be necessary for the axis of the wall 8 to remain coaxial with the annular jacket 13, i.e. by inclination about the fulcrum represented by the tang C. This is easily and reliably achieved if the funnel-shaped wall 7 can deform under the smail thrust transmitted to it by the wall 8, as shown in FIG. 4.

What is claimed is:

1. A pourer cap with closure cover for fluid substance containers, comprising a main body having an upper part and a lower part and a cover joined thereto by a flexible tang, all formed in one piece by moulding plastic material, in which the main body delimits a discharge channel and presents, in its lower part, a seat for housing and sealingly retaining the free edge of the neck of a fluid substance container, the main body and the cover having respective profiled portions mutually cooperating to retain the cover on the upper part of the main body to close said discharge channel, wherein the main body comprises a funnel-shaped wall which is inclined towards the bottom of said body and from which there extends a tubular wall which defines said discharge channel by combination with the opposing surface of an appendix supported on the inside of the tubular wall by at least one fin projecting from said tubular wall, the appendix having a free end projecting towards the top of the main body beyond said funnel-shaped wall, in the cover there being provided a delivery hole about the whole of which there extends an elongate annular jacket the free end of which is shaped as an outwardly diverging lip and is insertable and movable within said discharge channel to seal against said tubular wall of the main body, the delivery hole of the cover being superposed on and sealed by the free end of said appendix when in the closure position in which the cover is lowered onto the main body, the cover and main body being provided with profiled elements which mutually cooperate to limit the raising of the cover from the main body into the dispensing position in which the delivery hole of the cover is raised away from the free end of said appendix.

2. A cap as claimed in claim 1, wherein said funnel-shaped wall of the main body has a small thickness such as to flex under the thrust exerted on the tubular wall projecting from it by the tip of the annular jacket of the cover when in the position in which the cover is partially raised from the main body and said delivery hole is raised away from the free end of said appendix of the main body.

3. A cap as claimed in claims 1 or 2, wherein said profiled elements which mutually cooperate to limit the raising of the cover from the main body consist of retention teeth with inclined outer surfaces which mutually interfere and can snap one over the other when the two teeth are made to slide one along the other, one of the teeth forming part of the main body, and the other tooth projecting from a flexible tang extending from the cover.

* * * * *